US006113317A

United States Patent [19]

Myers

[11] Patent Number: 6,113,317

[45] Date of Patent: Sep. 5, 2000

[54] RETAINING WALL SYSTEM WITH INTEGRAL STORAGE COMPARTMENTS AND METHOD FOR STABILIZING EARTHEN WALL

[76] Inventor: Clinton Charles Myers, 3286 Fitzgerald Rd., Rancho Cordova, Calif. 95742

[21] Appl. No.: 09/089,191

[22] Filed: Jun. 2, 1998

[51] Int. Cl.[7] ..... E02D 17/00; E02D 17/20

[52] U.S. Cl. ..... 405/284; 405/262; 405/273; 405/286; 52/586.1; 52/592.6

[58] Field of Search ..... 405/262, 272, 405/273, 284, 286, 287; 52/578, 586.1, 591.3, 592.1, 592.2, 592.3, 592.6

[56] References Cited

U.S. PATENT DOCUMENTS

| | | | |
|---|---|---|---|
| 1,094,928 | 4/1914 | Popp . | |
| 1,434,612 | 11/1922 | Hamilton . | |
| 2,452,463 | 10/1948 | Herbert | 52/592.6 X |
| 3,685,244 | 8/1972 | Palmer | 52/592 |
| 3,686,873 | 8/1972 | Vidal | 405/262 |
| 3,922,864 | 12/1975 | Hilfiker | 61/35 |
| 4,068,482 | 1/1978 | Hilfiker | 61/47 |
| 4,117,686 | 10/1978 | Hilfiker | 405/284 |
| 4,154,554 | 5/1979 | Hilfiker | 405/273 |
| 4,260,296 | 4/1981 | Hilfiker | 405/284 |
| 4,266,890 | 5/1981 | Hilfiker | 405/286 |
| 4,324,508 | 4/1982 | Hilfiker et al. | 405/284 |
| 4,329,089 | 5/1982 | Hilfiker et al. | 405/262 |
| 4,343,572 | 8/1982 | Hilfiker | 405/284 |
| 4,391,557 | 7/1983 | Hilfiker et al. | 405/287 |
| 4,449,857 | 5/1984 | Davis | 405/286 |
| 4,505,621 | 3/1985 | Hilfiker et al. | 405/284 |
| 4,529,174 | 7/1985 | Pickett | 256/27 |
| 4,565,043 | 1/1986 | Mazzarese | 52/593 |
| 4,613,071 | 9/1986 | Omori | 237/9 |
| 4,616,959 | 10/1986 | Hilfiker | 405/286 |
| 4,643,618 | 2/1987 | Hilfiker et al. | 405/287 |
| 4,653,962 | 3/1987 | McKittrick et al. | 405/286 |
| 4,661,023 | 4/1987 | Hilfiker | 405/262 |
| 4,684,287 | 8/1987 | Wojciechowski | 404/6 |
| 4,725,170 | 2/1988 | Davis | 405/286 |
| 4,824,293 | 4/1989 | Brown et al. | 405/284 |
| 4,834,584 | 5/1989 | Hilfiker | 405/262 |
| 4,856,939 | 8/1989 | Hilfiker | 405/284 |
| 4,929,125 | 5/1990 | Hilfiker | 405/262 |
| 4,961,673 | 10/1990 | Pagano et al. | 405/287 |
| 4,992,005 | 2/1991 | Hilfiker | 405/284 |
| 4,993,879 | 2/1991 | Hilfiker | 405/262 |
| 5,076,735 | 12/1991 | Hilfiker | 405/284 |
| 5,103,616 | 4/1992 | Nordberg | 52/585 |
| 5,163,261 | 11/1992 | O'Neill | 405/284 X |

(List continued on next page.)

OTHER PUBLICATIONS

MSE Plus Retaining Wall Systems brochure, SSL, E. Scotts Valley Drive, Scotts Valley, CA 95066 (undated).

*Primary Examiner*—Eileen Dunn Lillis
*Assistant Examiner*—Jong-Suk Lee
*Attorney, Agent, or Firm*—Michael R. Schacht; Hughes & Schacht, P.S.

[57] ABSTRACT

A retaining wall system and method for stabilizing earthen walls comprises box members assembled together to form a reinforcing wall assembly and anchor mesh connected to the box members and buried within the earthen wall. The box members define an interior cavity and a rear wall that engages the face of the earthen wall. Waste material such as used tires or waste dirt may be placed within the interior chambers of the box members. The anchor mesh is attached to the rear wall to inhibit lateral movement of the reinforcing wall assembly. The box members are connected to the anchor mesh by locking pins that extend through loop portions of the anchor mesh and engage a front face of the wall panels. Anchor bars are connected to the loop portions of the anchor mesh. These anchor bars engage a back face of the box members to control and limit the movement of the box members relative to the anchor mesh as earth is back-filled against the box members. When the wall panels are concrete, a void network is formed in the panels to receive the anchor mesh loop portions and the locking pins. Pin windows may be formed in concrete wall panels to facilitate insertion of the locking pins.

13 Claims, 7 Drawing Sheets

U.S. PATENT DOCUMENTS

| | | | |
|---|---|---|---|
| 5,190,413 | 3/1993 | Carey | 405/286 |
| 5,214,897 | 6/1993 | Nordberg | 52/586 |
| 5,257,880 | 11/1993 | Janopaul, Jr. | 405/284 |
| 5,484,235 | 1/1996 | Hilfiker et al. | 405/284 |
| 5,487,623 | 1/1996 | Anderson et al. | 405/286 |
| 5,492,438 | 2/1996 | Hilfiker | 405/285 |
| 5,494,379 | 2/1996 | Anderson et al. | 405/262 |
| 5,522,682 | 6/1996 | Egan | 405/262 |
| 5,531,547 | 7/1996 | Shimada | 405/262 |
| 5,540,525 | 7/1996 | Miller et al. | 405/284 |
| 5,564,865 | 10/1996 | Jansson | 405/286 |
| 5,568,999 | 10/1996 | Egan et al. | 405/262 |
| 5,580,191 | 12/1996 | Egan | 405/262 |
| 5,582,492 | 12/1996 | Doyle, Jr. | 405/262 |

RETAINING WALL SYSTEM WITH INTEGRAL STORAGE COMPARTMENTS AND METHOD FOR STABILIZING EARTHEN WALL

TECHNICAL FIELD

The present invention relates to retaining wall systems and methods and, more specifically, to such systems and methods that contain storage compartments in which waste or fill material may be stored.

BACKGROUND OF THE INVENTION

Construction projects often require the formation of earthen walls having a vertical or nearly vertical face. These walls may be unstable and can collapse when subjected to a variety of natural conditions. For example, heavy precipitation can cause loose earth to fluidize, resulting in collapse of the earthen wall. In another situation, an earthquake will introduce lateral forces that may cause the earthen wall to collapse.

To stabilize such an earthen wall, a retaining wall system may be formed to reinforce the face thereof. At a minimum, the retaining wall system will maintain the shape of the earthen wall should the earth become semi-fluid. Additionally, retaining wall systems may be structurally designed to withstand lateral forces such as those introduced by earthquakes or other external forces or loading conditions.

A stabilized retaining wall system comprises a vertical wall portion and an anchor portion. The wall portion physically engages the earthen wall to stabilize the face thereof. The wall portion of a retaining wall may be wood, cast-in-place concrete, concrete panels, wire screen panels, or some combination thereof. The present invention relates to concrete wall members.

The anchor portion of a stabilized retaining wall system ties the retaining wall into the earthen wall to stabilize the retaining wall against lateral forces. Numerous techniques may be used to form such an anchor portion. The present invention relates to retaining walls that include such an anchor portion and, more specifically, to retaining walls having an anchor portion formed of buried wire mesh.

Because concrete is relatively expensive, it has long been recognized that fill material of one type or another can be mixed with the concrete to obtain a finished concrete member with a volume greater than that of the concrete employed. For example, relatively inexpensive aggregates such as gravel are commonly mixed with concrete to extend the bulk of the finished product.

In the context of retaining walls, the need exists for a concrete wall member that is relatively inexpensive to manufacture and lightweight and possesses sufficient strength to reinforce an earthen wall.

RELATED ART

The Applicant is aware of a system for manufacturing concrete blocks including baled used tires. The tires are initially baled and placed within a concrete form. Concrete mix is poured into the form and allowed to solidify around the tires. In theory, the used tires form a lightweight filler material for the block, and the block encapsulates the tires so that they are substantially permanently disposed of. And because people must pay to dispose of used tires, the cost of the concrete block can theoretically be reduced by the negative cost of the used tires. In practice, however, the wet concrete permeates the baled tires before it sets. This increases the cost and weight of the concrete employed, so the cost and weight of the block produced by this process are not sufficiently reduced to make this system practical.

A number of patents have been brought to the attention of the Applicant. The patents uncovered in these searches generally fall into one of four categories.

The first category includes patents that specifically relate to methods of manufacturing concrete panels incorporating waste material of some sort as a filler material. The following patents are included in this first category.

U.S. Pat. No. 5,214,897 to Nordberg also discloses a concrete block comprising used tires that are baled and encapsulated within concrete.

U.S. Pat. No. 5,103,616 to Nordberg similarly discloses a concrete block comprising used tires that are baled and encapsulated within concrete.

U.S. Pat. No. 3,685,244 discloses a concrete block comprising crushed old automobile bodies encapsulated within concrete.

U.S. Pat. No. 1,094,928 discloses a concrete block defining a lined interior chamber. The chamber reduces the weight of the block, while the liner reduces moisture permeation through the block.

The second category includes patents that relate to mechanically stabilized earth systems in which the panels that form the reinforcing wall are directly connected to anchor mesh or similar buried members. The following patents are included in the first category described above.

U.S. Pat. No. 4,324,508 to Hilfiker et al. discloses a retaining wall system in which rods are inserted through folded ends of reinforcing mats and behind pin members extending between adjacent edges of wall panels. The rods engage the pin members to prevent movement of the wall panels relative to the reinforcing mats.

U.S. Pat. No. 4,329,089 to Hilfiker et al. discloses a wall system in which anchor members are folded over and inserted through grid work sections forming the wall. Pins are inserted through loops formed by the folded anchor members to prevent withdrawal of the anchor members back through the grid work sections.

U.S. Pat. No. 5,494,379 to Anderson et al. discloses a wire mesh retaining wall that employs handle bar connectors to attach buried stabilizing members to wire mesh panels. The handle bar connectors are passed through loops formed in the stabilizing members. The loads to which the retaining wall may be subjected may straighten out the loops in the stabilizing members, thus rendering the retaining wall described in the Anderson et. al. patent unstable.

U.S. Pat. No. 4,505,621 to Hilfiker et al. discloses a retaining wall system in which reinforcing mats are comprised of longitudinal wires and cross wires. The longitudinal wires are bent to form floor and face sections and kinked in the face section. The floor sections are buried with a cross wire of one mat engaging longitudinal wires of an adjacent mat such that the face sections form the reinforcing wall. In this system, the retaining mats are integrally formed with the face sections.

U.S. Pat. Nos. 4,616,959 and 4,661,023 to Hilfiker discloses wall systems in which rods are received within grooves in concrete members forming the wall to connect soil reinforcing mats to the concrete members. In the '959 patent, the soil reinforcing mats are folded over the rods. In the '023 patent, the mats are connected directly to the rods.

U.S. Pat. No. 5,484,235 to Hilfiker discloses a wall system in which the soil reinforcing mat is directly received within grooves formed in upper and/or lower edges of the concrete blocks. When one block is stacked on top of another, the mats are trapped within the grooves.

U.S. Pat. No. 4,856,939 to Hilfiker discloses a wall system in which the soil reinforcing mat is in the form of grids that interlock with trays that define the wall. The trays are inserted through the grids to form the connection therebetween.

U.S. Pat. Nos. 4,260,296 and 4,266,890 to Hilfiker disclose wall systems in which vertical pins extend through holes in the wall panels and through plates connected to buried anchor rods; the buried rods stabilize the wall panels.

U.S. Pat. No. 3,922,864 to Hilfiker discloses a wall system in which flanges are threaded onto stretchers extending between a wall panel and a buried deadman.

U.S. Pat. Nos. 4,343,572, 4,643,618, and 4,391,557 discloses wall systems in which the reinforcing wall is cast in place and not formed of precast concrete wall panels.

U.S. Pat. No. 5,522,682 to Egan discloses a modular wall block system in which recesses are formed in edges of wall blocks or panels for connection to anchor material.

U.S. Pat. No. 5,540,525 to Miller et al. discloses a modular wall block system in which recesses are formed in edges of wall blocks or panels for connection to anchor material.

U.S. Pat. No. 5,190,413 to Carey discloses a modular wall block system in which recesses are formed in edges of wall blocks or panels for connection to anchor material.

The third category includes mechanically stabilized earth systems in which inserts are cast into wall panels and the anchor mesh is connected to these inserts. The following references are contained in the third category: U.S. Pat. Nos. 5,492,438, 4,993,879, 4,929,125, 4,834,584, and 4,154,554 to Hilfiker and U.S. Pat. No. 4,449,857 to Davis; U.S. Pat. No. 4,725,170 to Davis; and U.S. Pat. No. 4,653,962 to McKittrick.

The fourth category includes systems that are relevant to the present invention as background only. The following references are contained in this fourth category: U.S. Pat. Nos. 5,076,735, 4,992,005, 4,117,686, and 4,068,482 to Hilfiker, U.S. Pat. No. 5,647,695 to Hilfiker et al., U.S. Pat. No. 4,529,174 to Pickett, U.S. Pat. No. 4,684,287 to Wojciechowski, U.S. Pat. No. 5,531,547 to Shimada; U.S. Pat. No. 4,613,071 to Sams et al.; U.S. Pat. No. 1,434,612 to Hamilton; U.S. Pat. No. 2,351,768 to Kaping; U.S. Pat. No. 4,961,673 to Pagano et al.; U.S. Pat. No. 5,487,623 to Anderson et la.; U.S. Pat. No. 5,320,455 to Mattox; U.S. Pat. No. 5,568,999 to Egan et al.; and U.S. Pat. No. 5,580,191 to Egan.

OBJECTS OF THE INVENTION

From the foregoing, it should be apparent that a primary objective of the present invention is to provide improved retaining wall systems and methods.

Another more specific objective of the present invention is to provide improved retaining wall systems and methods having a favorable mix of the following characteristics:

effectively stabilize an earthen wall;

control any movement of the reinforcing wall assembly that may occur during formation of the earthen wall;

can dispose of waste material to reduce costs; and may be easily and inexpensively implemented.

SUMMARY OF THE INVENTION

These and other objects are obtained by the present invention, which is a retaining wall system or method employing reinforced concrete wall panels defining an internal chamber into which waste or fill material can be stored. The panels comprise five sides and an open top. Waste material such as baled used tires may be placed into the internal chamber through the open top for permanent disposal. Alternatively, fill material such as dirt excavated on site can be placed into the internal cavity. The panels are stacked one on top of one another to form a retaining wall assembly. A reinforced concrete lid member can be placed over the topmost wall panels to cover the internal chambers therein.

To facilitate stacking of the wall panels, an arrangement of projections and grooves is formed in the upper and lower edges of the panels. The grooves receive the projections to align upper and lower courses of wall panels and to inhibit lateral movement of one panel relative to another. A scupper hole is preferably formed in the bottom wall of the panel to prevent fluid accumulation within the interior chambers.

A connecting void network is preferably formed in one side of the wall panel. The anchor mesh is formed with loop portions that extend into the connecting void network of the wall panels. The locking pins are inserted through the loop portions to prevent the loop portions from being withdrawn from their connected position.

To prevent the loop portions of the anchor mesh from straightening under loads created by earth backfilled against the retaining wall, anchor bearing bars may be welded to the loop portions of the anchor mesh. These anchor bearing bars engage a back surface of the wall panels to prevent straightening of the anchor mesh loop portions beyond what is required to obtain a stable reinforcing wall system.

The present invention employs relatively lightweight, strong, and stable panel sections that provide the installer significant flexibility in fabricating a retaining wall for reinforcing earthen walls. For example, the panels may be used unfilled in a conventional manner. Or the panels may be filled with waste materials such as used tires either upon fabrication or installation. The negative costs of the used tires will reduce the cost of the retaining wall system. And in some situations, installing the retaining wall requires the excavation of dirt that is not appropriate for use as backfill material. Such dirt may simply be placed into the interior cavities defined by the wall panels and used as ballast rather than shipped to another location for disposal. Clearly, a combination of these options may be used as the situation warrants.

The system thus creates a stable reinforcing wall that may be easily and inexpensively installed and which provides the installer with significant flexibility.

DETAILED DESCRIPTION OF THE INVENTION

Figure 1:
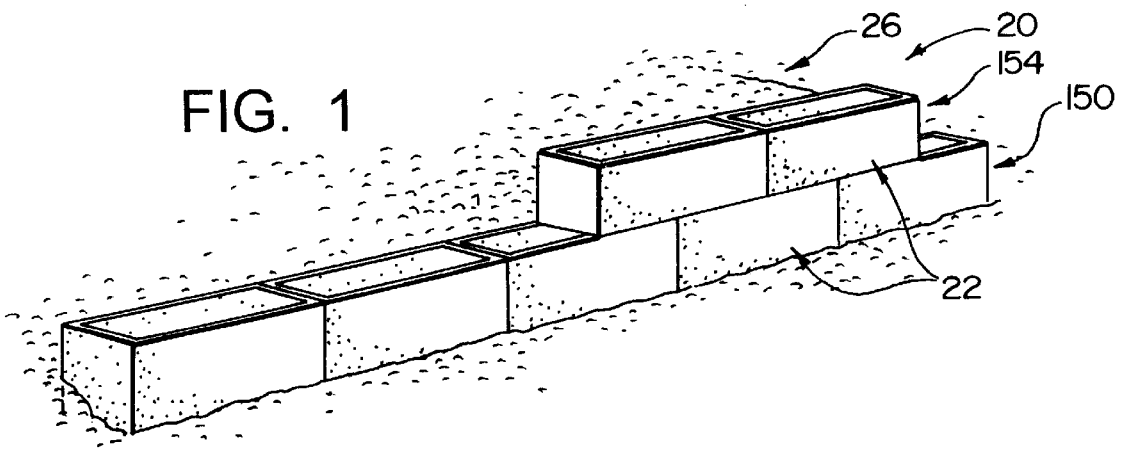
FIG. 1 is a perspective view of a retaining wall assembly employing wall panels constructed in accordance with principles present invention.
Figure 2:
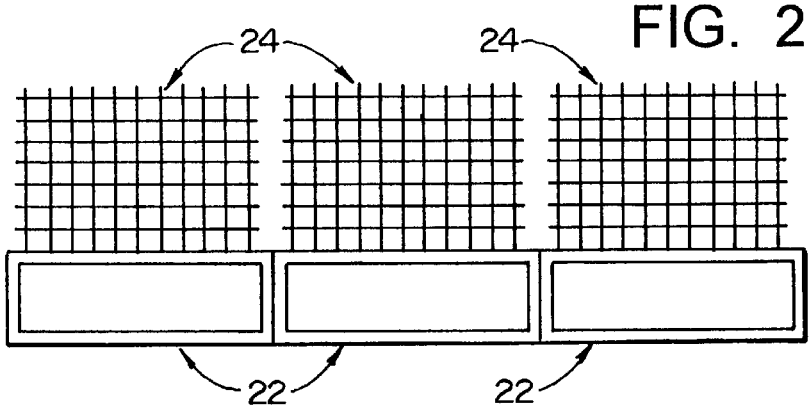
FIG. 2 is a top plan view depicting several retaining wall panels and anchor mesh that have been assembled together to form a retaining wall.
Figure 8:
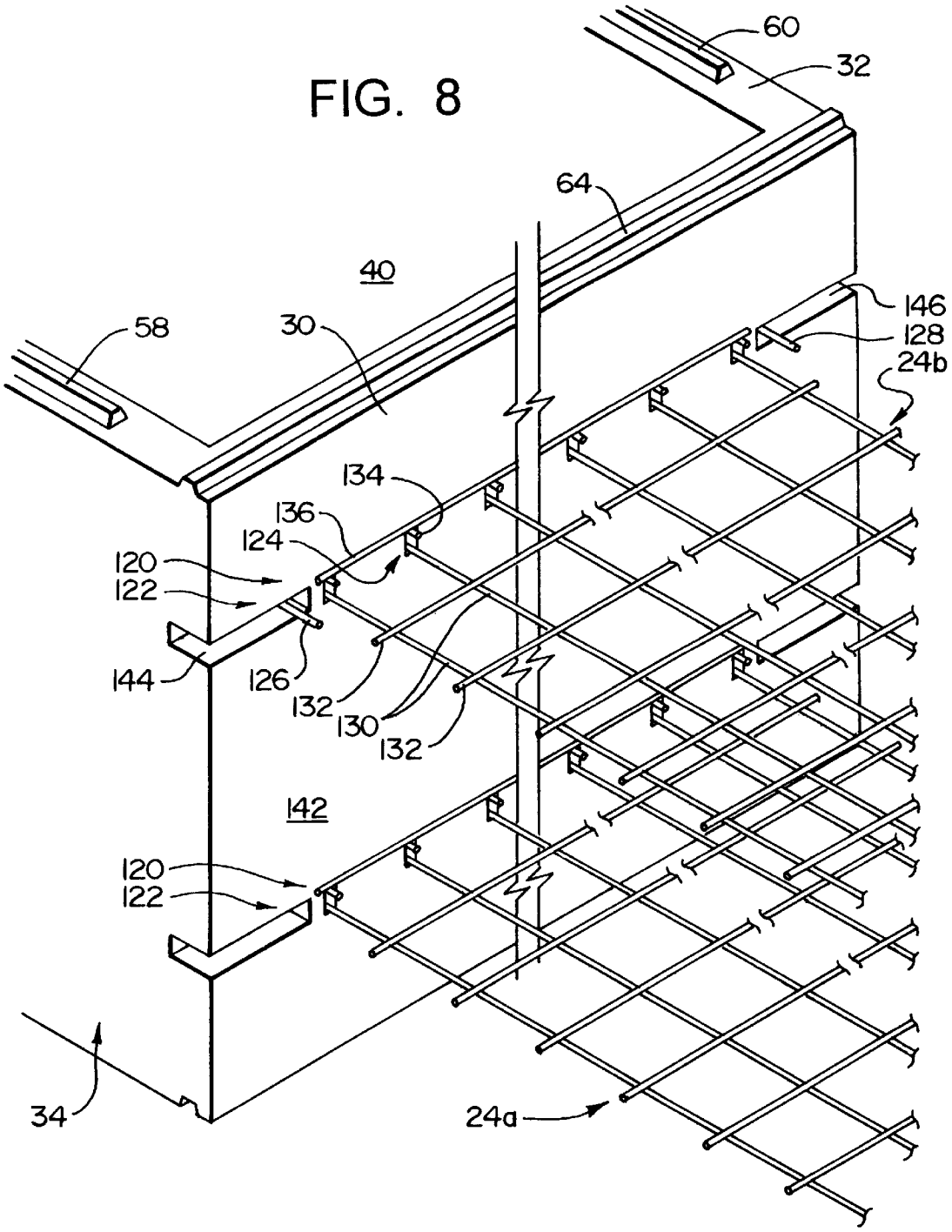
FIG. 8 is a rear perspective view showing details of the connection between a wall panel such as is shown in FIG. 3 and sheet of anchor mesh.
Figure 12:
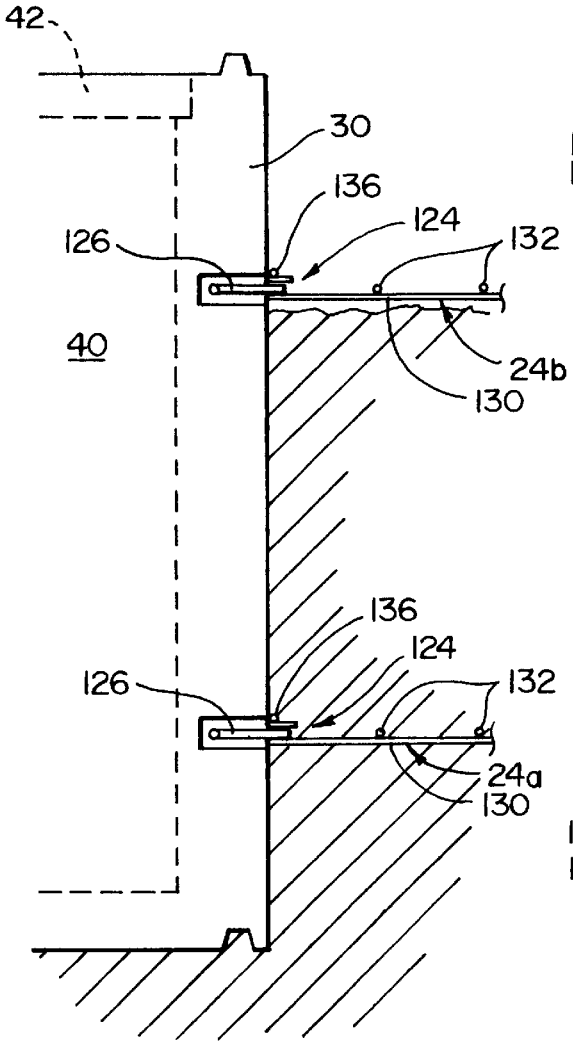
FIG. 12 is an end elevational view showing the connection between a wall panel and two layers of buried anchor mesh.
Figure 13:
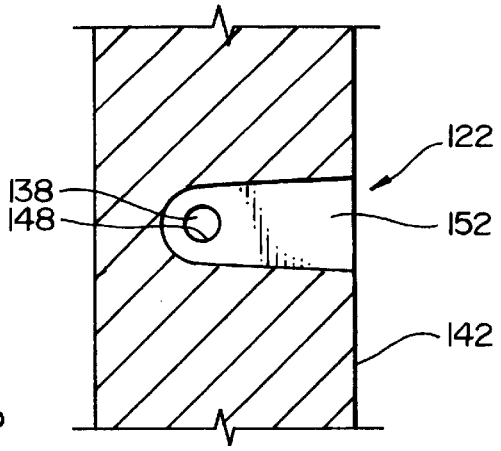
FIG. 13 is a section view showing a portion of the connecting void network.

Referring initially to FIG. 1, depicted therein is a retaining wall system 20 constructed in accordance with, and embodying, the principles of the present invention. The retaining wall system 20 comprises a plurality of retaining wall box members 22 and sheets of anchor mesh 24 (FIGS. 2 and 8). The retaining wall system 20 reinforces an earthen wall 26 as shown in FIGS. 1 and 12.

FIG. 2 shows that a typical retaining wall system constructed in accordance with present invention will comprise a plurality of retaining wall box members 22. FIG. 2 illustrates that these retaining wall box members 22 are laid in courses in much the same manner as bricks or cinder blocks.

Referring now to FIGS. 3–9, the wall box members 22 will be described in further detail. In particular, each wall box member 22 comprises front side, rear side, left end, right end, and bottom walls 28, 30, 32, 34, and 36. The sixth side of the box member 22 is open as shown at 38 in FIG. 3. The walls 28–36 define an interior chamber 40, and access to this chamber 40 is through the open side 38. Optionally, a lid member 42 may be provided to close the open side 38 and cover the interior chamber 40.

Figure 4:
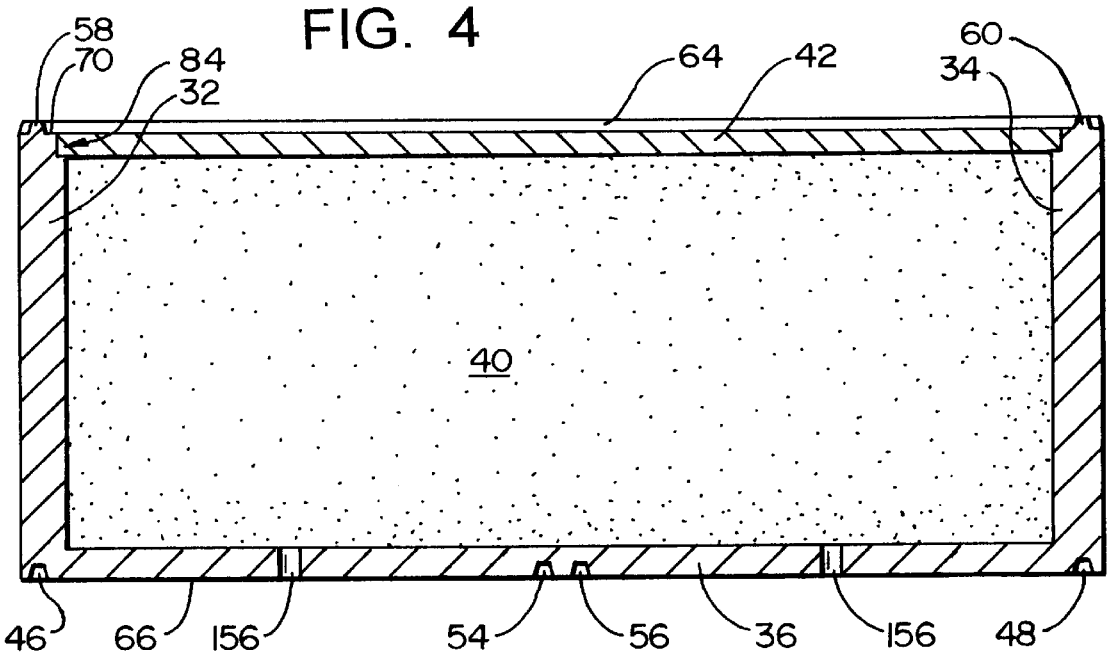
FIG. 4 is a side elevational cut-away view taken along lines 4—4 in FIG. 3.
Figure 5:
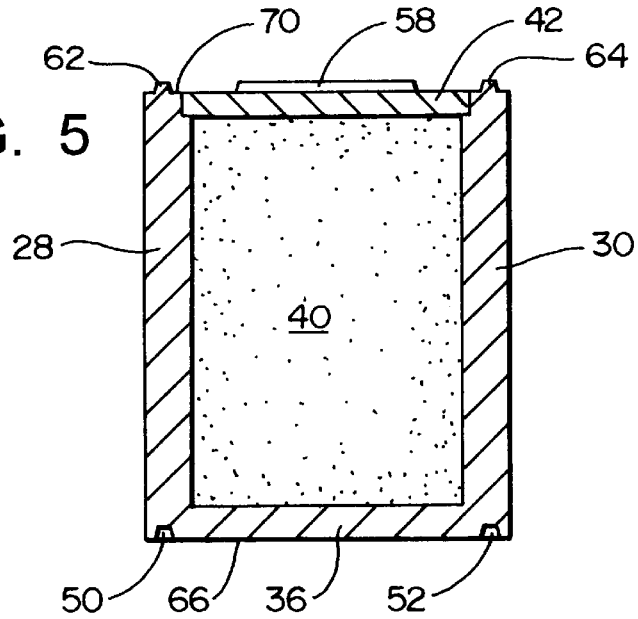
FIG. 5 is an end elevational cut-away view taken along lines 5—5 in FIG. 3.
Figure 6:
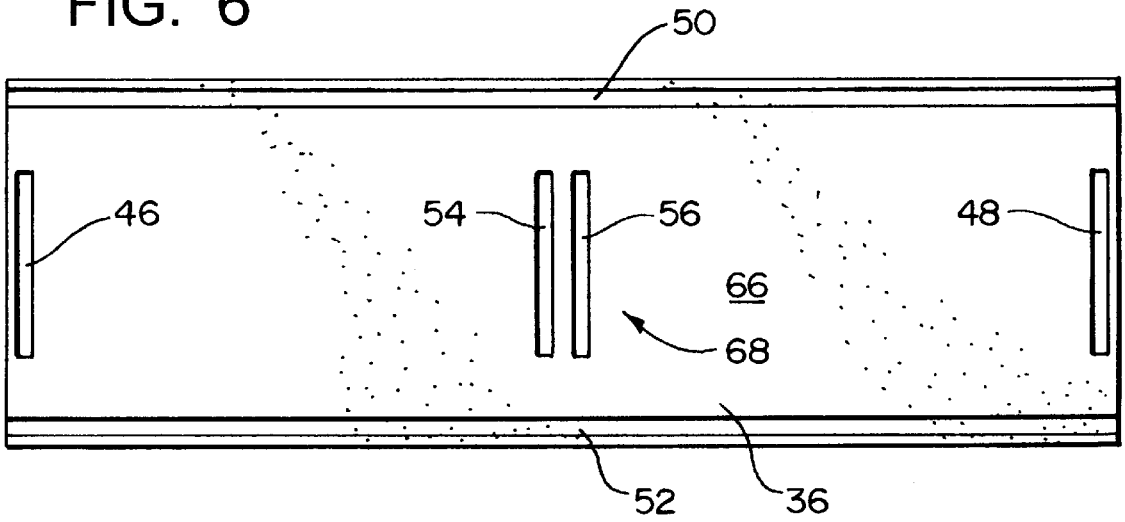
FIG. 6 is a bottom plan view of the wall panel shown in FIG. 3.

As perhaps best shown in FIGS. 4–6, a registration system allows the box members 22 to be stacked one on top of the other. The registration system allows the box members 22 to be stacked either in a running bond configuration as shown in FIG. 1 or an aligned configuration (not shown) in which each panel is stacked directly on top of a panel below.

Figure 3:
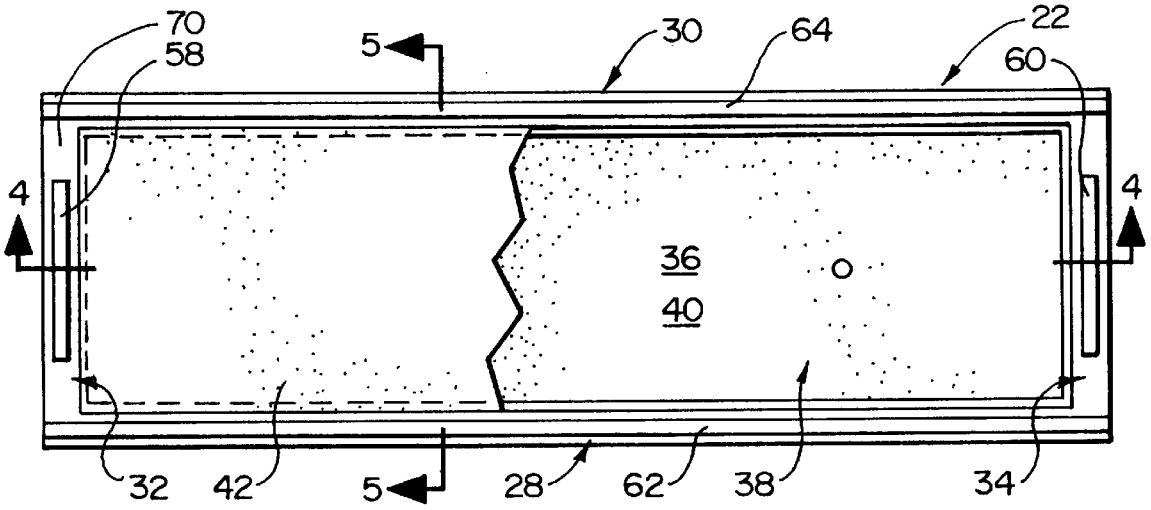
FIG. 3 is a top plan view depicting a single retaining wall panel and a portion of a lid for covering the wall panel, with certain internal features of the retaining wall being depicted by broken lines.

In particular, the exemplary registration system 44 (partially illustrated in FIG. 7) comprises first and second end grooves 46 and 48 (FIGS. 5 and 6), first and second side grooves 50 and 52 (FIGS. 4 and 6), first and second middle grooves 54 and 56 (FIGS. 4 and 6), first and second end projections 58 and 60 (FIGS. 3, 4, and 5), and first and second side projections 62 and 64 (FIGS. 3, 4, and 5).

The grooves 46–64 are formed in a bottom surface 66 of the box member 22. The end grooves 46 and 48 are located below the left and right end walls 32 and 34, respectively. The side grooves 50 and 52 are located below the front and back side walls 28 and 30, respectively. The middle grooves 54 and 56 are located adjacent to each other and are arranged substantially parallel to the end grooves 46 and 48; the middle grooves 54 and 56 are substantially perpendicular to the first and second side side grooves 50 and 52. The middle grooves 54 and 56 are symmetrically arranged at a location 68 that is substantially equidistant from the side walls 28 and 30 and from end walls 32 and 34.

The first and second end projections 58 and 60 are formed on an top surface 70 of the box member 22 above the left and right end walls 32 and 34, respectively. The first and second side projections 62 and 64 are formed on the top surface 70 above the front and back side walls 28 and 30, respectively.

Figure 7:
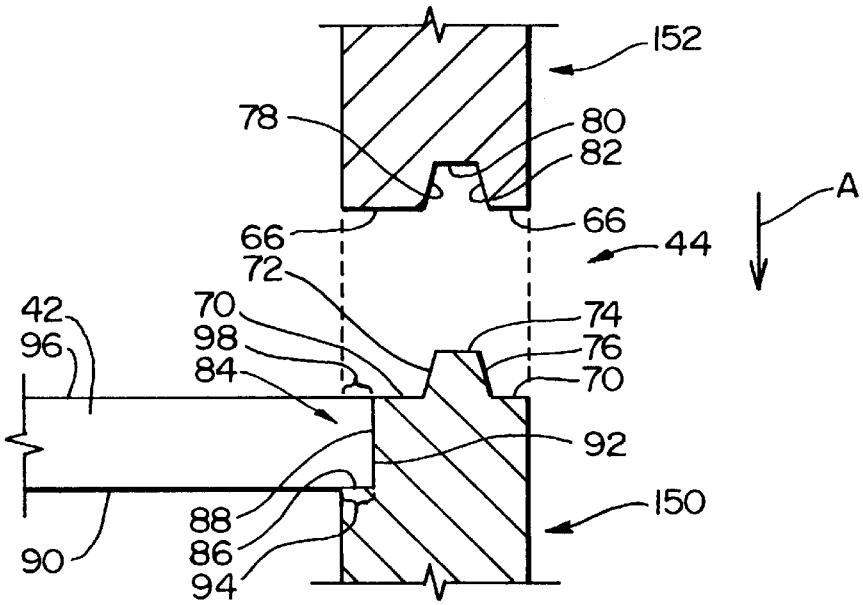
FIG. 7 is a partial cut-away view depicting details of assembly of one wall panel on top of another, with an optional lid for covering the lowermost wall panel depicted by broken lines.

As shown in FIG. 7, the grooves and projections are provided with matching trapezoidal shapes that allow the box member 22 to be easily fabricated and the projections to be snugly received within the grooves. In particular, each projection defines inner, upper, and outer projection surfaces 72, 74, and 76. And each groove defines inner, upper, and outer groove surfaces 78, 80, and 82. The bottom surface 66, top surface 70, and upper surfaces 74 and 80 are generally horizontal, while the inner projection and surfaces 72 and 78 and outer projection and groove surfaces 74 and 82 are canted towards the upper surfaces 74 and 80 at an angle (with respect to vertical.

As the uppermost panel is displaced downwardly as shown by arrow A in FIG. 7, the inner and outer projection surfaces 72 and 76 will engage the inner and outer groove surfaces 78 and 82. The inward cant of these surfaces 72, 76, 78, and 82 helps to align the upper panel with the lower panel. When the upper panel rests on the lower panel, the bottom surface 66 of the upper panel bears on the top surface 70 of the lower panel to transfer the weight of the upper panel to the lower panel.

When an upper panel is stacked directly on top of the panel therebelow, the end projections 58 and 60 are received within the end grooves 46 and 48. In this case, the middle grooves 54 and 56 are empty. When the upper panels are staggered relative to the panels below to form a running bond as shown in FIG. 1, the end projections 58 and 60 are received within the middle grooves 46 and 48 and the end grooves 46 and 48 are empty.

As should be clear from the foregoing, the projections and grooves may be transposed and the invention will still function as described.

FIGS. 4, 5 and 7 illustrate in further detail how the lid member 42 engages the box member 22 to close the open side 38 and cover the interior chamber 40 defined by the box member 22.

In particular, a continuous notch 84 is formed in the box member 22 that extends along the panel walls 28, 30, 32, and 34 adjacent to the top surface 70. The notch 84 is defined by a horizontal notch surface 86 and a vertical notch surface 88. The lid member 42 defines a lid lower surface 90 and an edge surface 92. The lid lower surface 90 comprises a lower perimeter portion 94 that extends around the perimeter of the lid lower surface 90 adjacent to the edge surface 92.

When the lid member 42 is placed onto a box member 22, the perimeter portion 94 of the lid lower surface 90 bears on the horizontal notch surface 86. The dimensions of the lid member 42 and notch vertical surface 92 are such that the lid member 42 fits snugly within the notch 84 with a lid upper surface 96 being flush with the top surface 70 of the box member 22.

Additionally, when a lid member 42 is used, the bottom surface 66 of an uppermost panel will engage an upper perimeter portion 98 of the lid upper surface 96. This upper perimeter portion 98 extends around the lid upper surface 96 immediately above the lower perimeter portion 98. A portion of the weight of the uppermost panel will thus be transferred to the lowermost panel through the edge of the lid member 42. This will secure the lid member 42 within the notch 84.

Referring now to FIGS. 8–14, depicted therein is a connecting system 120 that allows the wall box members 22 to be connected to the anchor mesh 24. A connecting system 120 is provided for each sheet of anchor mesh 24.

The connecting system 120 comprises a connecting void network 122 formed in the rear wall 30, loop portions 124 formed by the anchor mesh 24, and locking pins 126 and 128. In general, the loop portions 124 extend into the void network 122, and the locking pins 126 and 128 extend through the loop portions 124 and prevent the loop portions 124 from being withdrawn from the void network 122.

More specifically, each sheet of anchor mesh 24 is comprised of a plurality of tensile members 130 and a plurality of transverse members 132; these members 130 and 132 welded into a rectangular grid or array. The tensile members 130 transmit horizontal tensile loads on the box members 22 back to the transverse members 132, and the transverse members 132 transfer these loads into the earthen wall 26.

Figure 14:
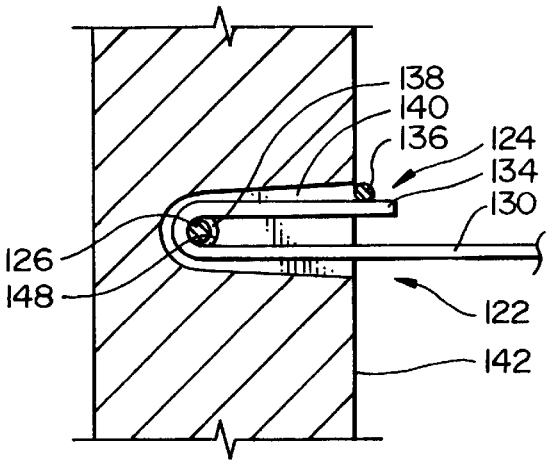
FIG. 14 shows the engagement of a connecting pin with a loop portion of the anchor mesh within the connecting void network.

As perhaps best shown in FIG. 14, the loop portions 124 are formed by bending proximal ends 134 of the tensile members 130 approximately 180( back towards the main portion of the anchor mesh 24. An anchor bearing bar 136 is rigidly connected by welding or the like to the proximal ends 134.

The connecting void network 122 comprises a pin void 138 that extends between the left side wall 32 and the right side wall 34. The network 122 further comprises a series of mesh voids 140 that open up to an outer surface 142 of the rear wall 30. And finally, the network 122 comprises first and second pin windows 144 and 146. All of these voids 138, 140, 144, and 146 are formed by lubricated inserts that are cast into the box member 22 and removed after the box member 22 hardens. Preferably, these lubricated inserts are metal or plastic members that are greased and reused.

As shown and FIG. 4, the mesh voids 140 are spaced along the outer surface 142 such that they are in communication with the pin void 138. The pin windows 144 and 146 are formed adjacent to the left side wall 32 and right side wall 34, respectively, and are similarly in communication with pin void 138. The mesh voids 140 are symmetrically arranged along the outer surface 142 of the box member 22 and are spaced at a distance determined by the spacing of the tensile members 130 from each other.

As shown and FIGS. 8 and 10–14, the anchor mesh 24 is attached to be box member 22 to form the system 20 by inserting the loop portions 124 of the tensile member proximal ends 134 into the mesh voids 140. Then, the locking pins 126 and 128 are inserted into opposite ends of the pin void 138 such that that the pins 126 and 128 pass through the loop portions 124. The locking pins 126 and 128 transfer tensile loads on the tensile members 130 to a void surface 148 of the box member 22 that defines the connecting void network 122. The locking pins 126 and 128 thus rigidly connect the tensile members 130 to the box member 22.

Figure 11:
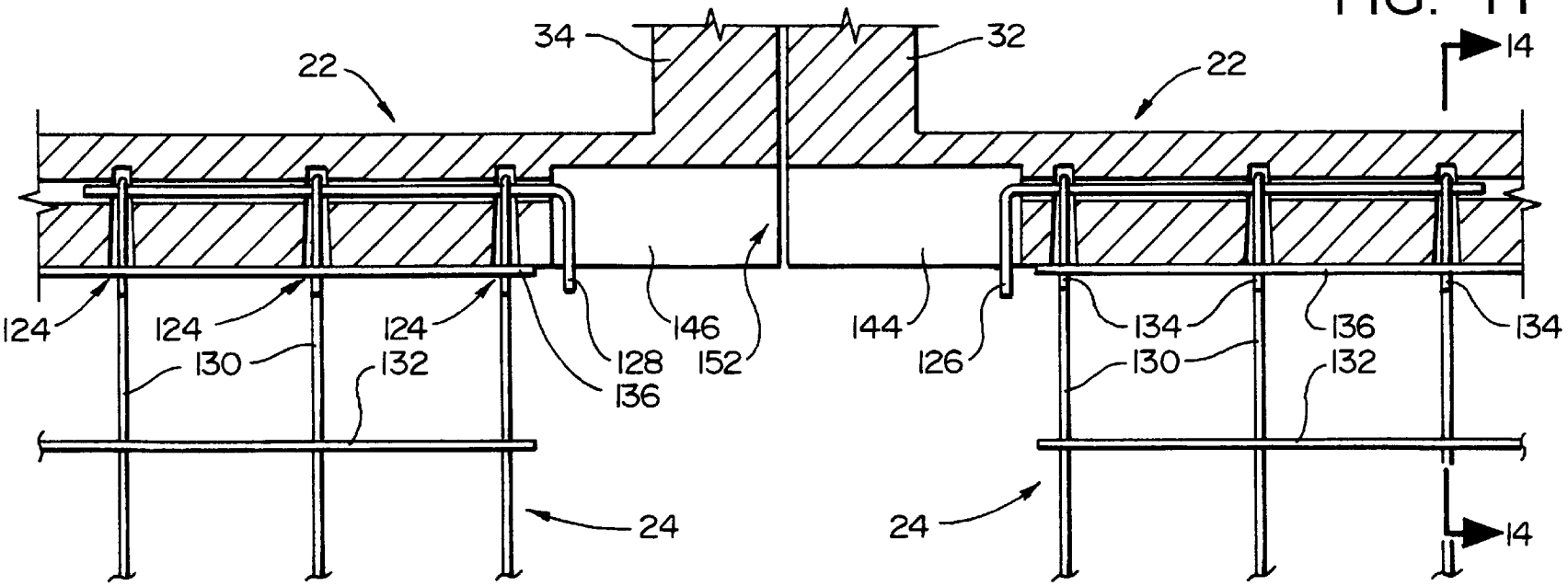
FIG. 11 is cut-away view taken along lines 11—11 in FIG. 9.

The anchor bearing bar 136 strengthens the connection between the anchor mesh 24 and the box member 22. In particular, when earth is backfilled against the outer surface 142, very large tensile loads will be transferred by the tensile members 130 to the panels 122; these loads are of sufficient magnitude that they can actually straighten out the loop portions 124 of the tensile members 130. If this occurs, the connection between the box member 22 and sheet of anchor mesh 24 may fail. The anchor bearing bar 136 engages the outer surface 142 of the panel rear wall 30 as shown in FIGS. 8, 11, and 14 to prevent straightening of the proximal ends 134. The anchor bearing bar 136 further ensures that the anchor mesh 24 extends at a right angle from the outer surface 142 of the rear wall 30.

The system 20 is installed at a desired location as follows. Initially, an optional footer (not shown) may be formed. A first course 150 (FIG. 1) of box members 22 is then laid at the desired location with left end and right end walls 32 and 34 of adjacent panels closely abutting each other. When laying the first course 150, the upper surfaces 70 of the panels forming this first course should be substantially coplanar with each other and will normally be horizontal. So laid, the pin windows 146 and 148 of the adjacent panels will be aligned to form a pin cavity 152 having five closed sides and one open side coplanar with the exterior surfaces 142 of the box members 22.

The loop portions 124 of the lower sheets of anchor mesh 24*a* are then inserted into the mesh voids 140 of the lower connecting void network 120*a*. The locking pin 126 is placed into the pin cavity 152 and then inserted into the pin void 138 of one of the box members 22 such that the proximal ends 124 are retained within the mesh voids 40. The other locking pin 128 is then placed into the pin cavity 152 and inserted in the opposite direction into the pin void 138 of the other of the box members 22 to retain the proximal ends 124 of the other lower anchor mesh sheet 24*a* within the mesh voids 40.

Dirt is then backfilled against the outer surfaces 142 of the box members 22 until it reaches the height of the uppermost connecting void network 122 of that course 150 of box members 22. The process described above is repeated to connect the uppermost sheets of anchor mesh 24*b* to the box member 22.

A second course 154 (FIG. 1) (and additional courses if desired) of box members 22 may be stacked on top of the first course 150. After laying each subsequent course, dirt is backfilled against the outer surfaces 142 up to the height of the next connecting void network 122, and another sheet of anchor mesh is attached thereto.

As shown in FIG. 4, sump holes 156 are preferably formed in the bottom walls 36 of the box members 22. These sump holes allow water and other liquids that accumulate within the interior chambers 40 to drain.

Figure 9:
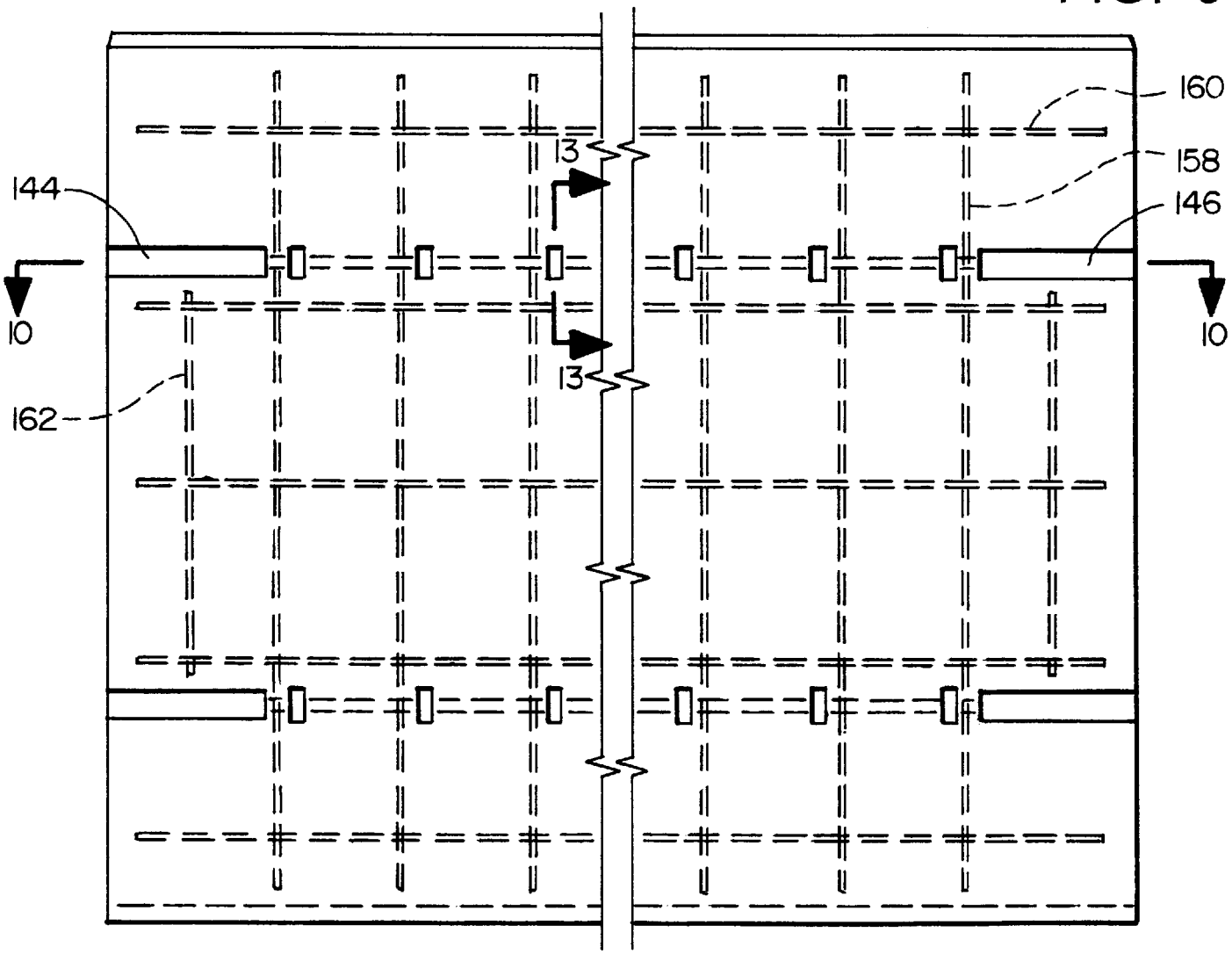
FIG. 9 is a rear elevational view of the wall panel of FIG. 3, with the connecting void network and reinforcing bars depicted in broken lines.
Figure 10:
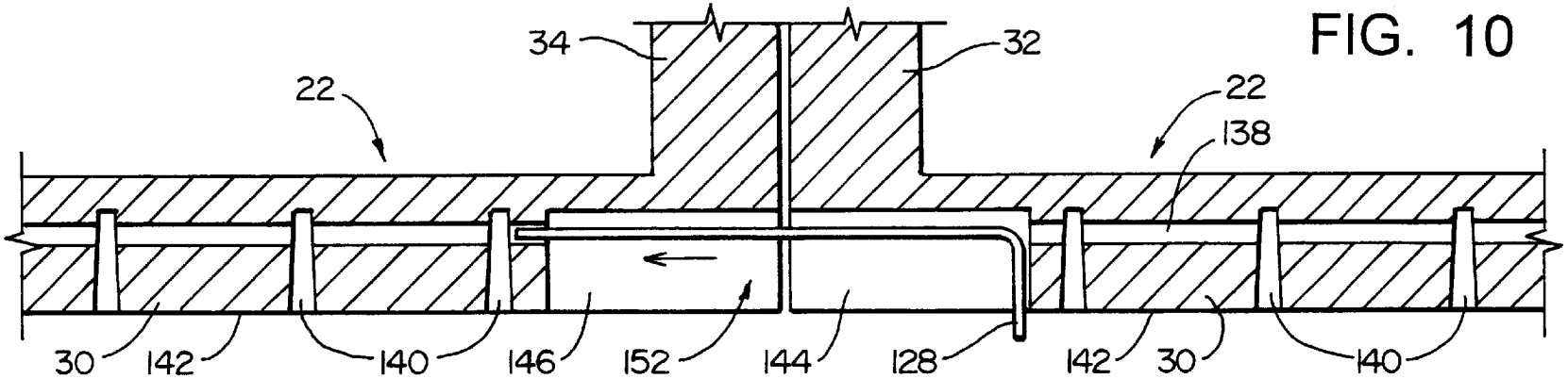
FIG. 10 is cut-away view taken along lines 10—10 in FIG. 9.

FIG. 9 depicts in broken lines an exemplary array of vertical rebar members 158 and horizontal rebar members 160 that may be used to reinforce the rear walls 30 of the box members 22. Truncated vertical rebar members 162 are used adjacent to the vertical edges of the rear wall 30 to allow formation of the pin windows 144 and 146.

The interior chambers 40 of the box members 22 may be left empty, filled with negative cost waste such as bailed use tires at the manufacturing facility, or filled with waste, such as dirt that is inappropriate for formation of the earthen wall 26, at the job site.

Unlike prior art precast concrete products in which concrete is poured around waste such as used tires, the box members 22 of the present invention are cast first and then filled with waste. This prevents concrete from permeating the waste, which reduces the cost of concrete and weight of the finished product. This also significantly increases the flexibility of the installation process; the installer may add, or not, the filler at any point after the box member 22 has been manufactured.

One of ordinary skill in the art will recognize that the present invention may be embodied in forms other than those described above and still practice the present invention. The scope of the present invention should thus be determined by reference to the following claims rather than the foregoing detailed description.

What is claimed is:

1. A retaining wall system for stabilizing an earthen wall, comprising:

at least one box member defining an interior chamber and having a first and second side walls, a bottom wall, a front wall, and a rear wall, where the rear wall engages a face of the earthen wall;

filler material placed within the interior chamber and on the bottom wall of the box member such that the filler material is substantially contained by the box member;

anchor mesh buried within the earthen wall, the anchor mesh having a proximal edge defining a connecting portion, where the connecting portion extends through at least a portion of the rear wall of the box member; and a connecting member that engages the connecting portion of the anchor mesh to maintain a position of the box member relative to the anchor mesh and thereby stabilize at least a portion of the earthen wall;

the box member is a concrete member having a connecting void network formed therein;

the connecting portion of the anchor mesh comprises a loop portion and the connecting member comprises a locking pin that extends at least partly into the connecting void network;

the connecting void network comprises a plurality of mesh voids, and a pin void in communication with the mesh voids; and the locking pin extends through the pin void and the mesh voids.

2. The system as recited in claim 1, in which the box member comprises projections on one of upper and lower surfaces of the box member and grooves on the other of the upper and lower surfaces of the box member, where the grooves and projections extend between front and back walls of the box member and the grooves accommodate the projections when the box members are vertically aligned with the box members below and when the box members are in a predetermined vertically misaligned relationship with the box members below.

3. The system as recited in claim 1, in which the box member has an open side, and the filler material is placed within the interior chamber through the open side.

4. The system as recited in claim 3, further comprising a lid member for covering the open side of the box member.

5. The system as recited in claim 1, further comprising a sump hole formed in a bottom wall of the box member.

6. The system as recited in claim 1, in which:

the locking pin comprises first and second locking pin sections; and the connecting void network comprises first and second pin windows; wherein the pin windows of adjacent box members align to allow the first locking pin section to be inserted into the pin void through the first pin window and the second locking pin section to be inserted into the pin void through the second pin window.

7. A method of stabilizing an earthen wall having a face, the method comprising the steps of:

providing anchor mesh comprising a proximal end defining a connecting portion;

arranging the anchor mesh on a first layer of the earthen wall with the connecting portion extending adjacent to the face of the earthen wall;

providing a box member defining an interior chamber and having first and second side walls, a front wall, a rear wall, and a bottom wall, where the box member is a reinforced concrete member;

arranging the box member and the anchor mesh such that the rear wall of the box member engages and stabilizes a face of the earthen wall, wherein the connecting portion of the anchor mesh extends through at least a portion of the rear wall of the box member;

inserting a connecting member formed by a plurality of locking pins through the connecting portion of the anchor mesh; and placing filler material within the interior chamber and on the bottom wall of the box member such that the filler material is substantially contained by the box member;

forming a second layer of the earthen wall such that anchor mesh is buried and the earthen wall acts on the rear wall of the box member; wherein when the earthen wall acts on the rear wall of the box member, the connecting member engages the connecting portion of the anchor mesh to maintain a position of the box member relative to the anchor mesh and thereby stabilize at least a portion of the earthen wall;

forming a connecting void network in each of the rear walls of the box members, where the connecting void networks comprise a pin void and a plurality of mesh voids;

inserting the connecting portion of the anchor mesh into the mesh voids such that the connecting portion is aligned with pin voids of the box members; and inserting the locking pins into the pin voids and thus through the connecting portion of the anchor mesh.

8. The method as recited in claim 7, further comprising the step of assembling a plurality of box members to form a retaining wall assembly that stabilizes the earthen wall.

9. The method as recited in claim 7, in which the step of inserting the locking pins into the pin voids comprises the steps of:

forming the connecting void network comprising first and second pin windows;

providing first and second locking pins for each box member;

arranging the box members such that the pin windows on adjacent box members are aligned;

laterally displacing the first and second locking pins entering a pair of aligned pin windows; and displacing the first and second locking pins along their axes towards each other.

10. The method as recited in claim 7, further comprising the steps of:

forming projections on one of upper and lower surfaces of the box member; and forming grooves on the other of the upper and lower surfaces of the box member; wherein the grooves are formed such that the grooves accommodate the projections when the box members are vertically aligned with the box members below and when the box members are in a predetermined vertically misaligned relationship with the box members below.

11. The method as recited in claim 7, further comprising the steps of:

forming the box member comprising at least one open side; and placing the filler material within the interior chamber through the open side.

12. The method as recited in claim 11, further comprising the step of covering the open side of the box member with a lid member.

13. The method as recited in claim 7, further comprising the step of forming a sump hole in a bottom wall of the box member.

* * * * *